US007575068B2

(12) United States Patent
Stubben

(10) Patent No.: US 7,575,068 B2
(45) Date of Patent: Aug. 18, 2009

(54) FULL SUPPORT BEARING FOR GRADER CIRCLE

(75) Inventor: David William Stubben, Dubuque, IA (US); Gladys Stubben, legal representative, Hazel Green, WI (US)

(73) Assignee: Deere & Company, Moline, IL (US)

( * ) Notice: Subject to any disclaimer, the term of this patent is extended or adjusted under 35 U.S.C. 154(b) by 102 days.

(21) Appl. No.: 11/590,391

(22) Filed: Oct. 31, 2006

(65) Prior Publication Data

US 2008/0110651 A1 May 15, 2008

(51) Int. Cl.
*E02F 3/00* (2006.01)

(52) U.S. Cl. ..... 172/781; 172/792; 172/796; 172/445.2; 74/448

(58) Field of Classification Search ..... 172/781, 172/791, 792, 795, 796, 445.2, 815, 789, 172/797; 37/234; 74/447, 448
See application file for complete search history.

(56) References Cited

U.S. PATENT DOCUMENTS 3,463,243 A * 8/1969 Fisher ..... 172/781
3,470,967 A * 10/1969 Easterling et al. ..... 172/793
3,568,778 A * 3/1971 Swisher et al. ..... 172/785
3,712,384 A * 1/1973 Fisher ..... 172/796
3,888,357 A * 6/1975 Bauer et al. ..... 212/175
3,989,112 A * 11/1976 Cole et al. ..... 172/796
4,015,669 A * 4/1977 Cole ..... 172/796
4,099,577 A * 7/1978 Beckham et al. ..... 172/781
4,113,032 A * 9/1978 Cole ..... 172/781
4,185,700 A * 1/1980 Atherton et al. ..... 172/796
4,206,818 A * 6/1980 Beckham et al. ..... 172/781
4,622,860 A * 11/1986 Cametti et al. ..... 74/448
5,667,020 A * 9/1997 Palmer et al. ..... 172/781
5,720,353 A * 2/1998 Wilkening ..... 172/795
6,851,486 B2 * 2/2005 Marshall ..... 172/792

* cited by examiner

*Primary Examiner*—Thomas B Will
*Assistant Examiner*—Joel F Mitchell

(57) ABSTRACT

A full support bearing for a grader circle including a first radial groove in a cylindrical portion of the circle includes a group of inserts forming a second support groove within the first radial groove. It also includes circle supports sized and shaped such that the gap between any two circle supports is small. The circle supports are arranged along a circumference of the circle and rigidly attached to a draw bar. The arrangement results in virtual 360 degree circle support, lower loads, and smaller material deflections at all loaded areas, and significantly increased durability due to a resultant reduction in wear rates.

8 Claims, 6 Drawing Sheets

FIG. 4
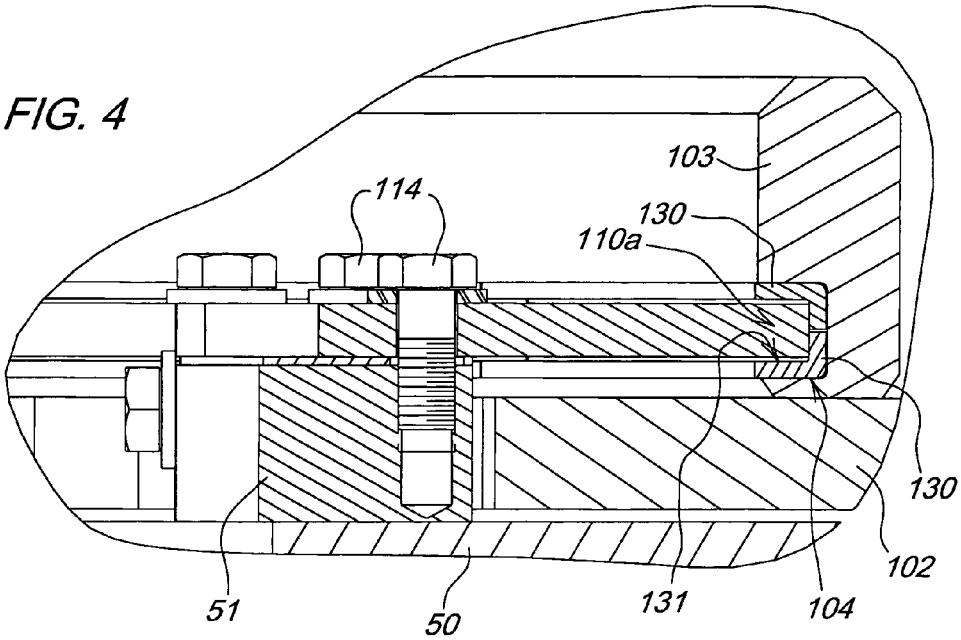
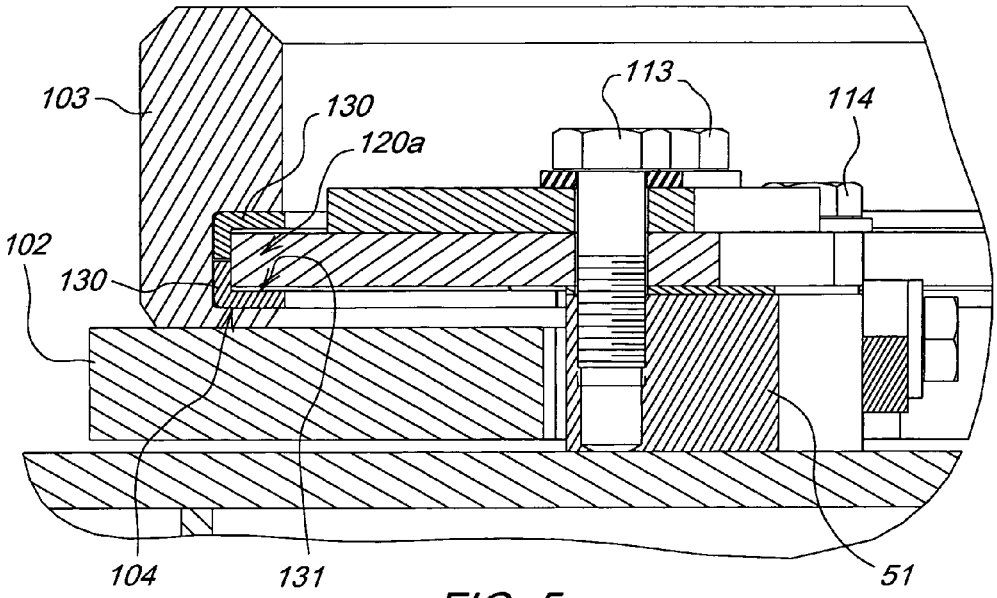
FIG. 5

FIG. 7
(PRIOR ART)
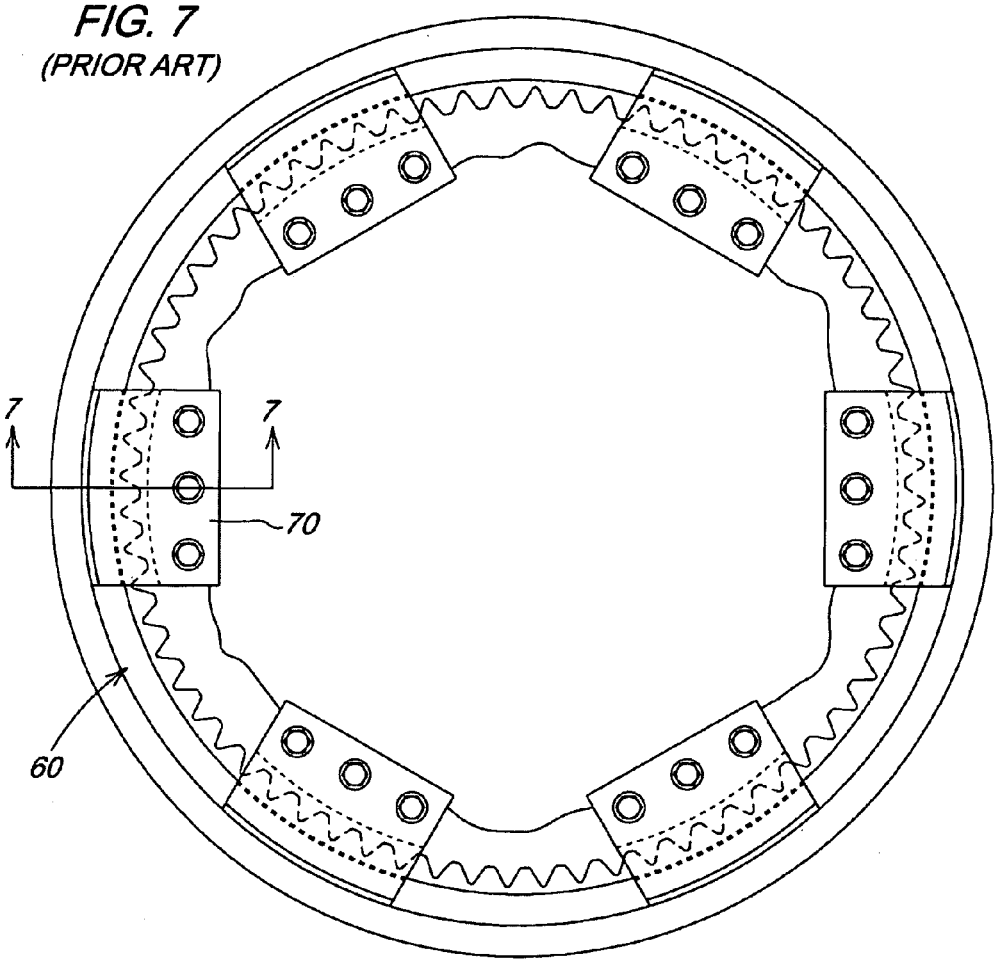
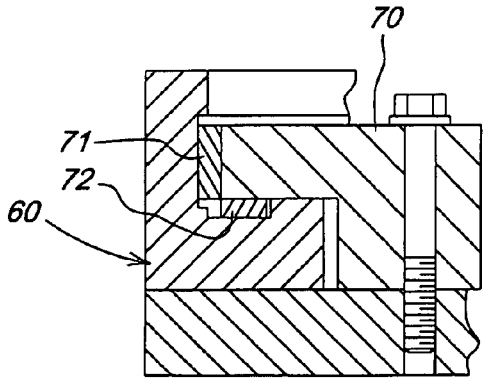
FIG. 8
(PRIOR ART)

FULL SUPPORT BEARING FOR GRADER CIRCLE

FIELD OF THE INVENTION

The invention relates to a mechanism and method for increasing the durability of a structural support for a circle of a motor grader. More particularly, the invention relates to a structural support system for reducing the wear on structural supports relative to the circle of a motor grader.

BACKGROUND OF THE INVENTION

Motor graders include, inter alia, a longitudinal mainframe having at a forward end, a wheel support and, at a rear end, an operator's cab; and a rear frame of for the motor and power train located behind the cab. The motor grader blade is suspended from the mainframe by means of a draw bar and a circle. The circle is mounted on the rear portion of the draw bar and must, typically, be controlled with a high degree of precision.

The blade of the motor grader must, typically, be controlled with a high degree of precision as it often serves as a finishing instrument. The surfaces on which the circle rotates are, due to their locations and structures, generally subject to somewhat high rates of wear. Thus, conventional motor graders typically require frequent adjustment or replacement of wear parts to satisfactorily perform their accurate finish operations as excessive wear results in imprecision with respect to blade control.

SUMMARY OF THE INVENTION

As stated above, conventional motor graders typically require frequent adjustment to satisfactorily perform their finish operations to the degree of accuracy usually required. This is at least partially due to rapid wear on circle wear inserts. Typically, there are 12 wear inserts, as well as six circle supports, at six specific and discreet support locations around the circle. Such is typical of all manufactures. Additionally, the locations of the wear inserts and circle supports allow significant material deflections under load. These deflections result in increased normal loads at the end of at least two and circle supports. Elevated normal loads cause increased friction and reduced circle efficiency and torque.

The invention provides positions, sizes and shapes of circle wear inserts and circle supports to support the circle at virtually every point around its 360 degree perimeter. Thus, the circle is virtually completely supported in both horizontal and vertical directions.

Due to the very large wear area provided by the invention, normal loads are reduced and wear life is increased to allow a significantly longer time of blade use without adjustment or replacement. Further, the efficiency of the circle is increased as the normal loads and material deflections are greatly reduced.

BRIEF DESCRIPTION OF THE DRAWINGS

The invention will be described in detail, with references to the following figures, wherein:

FIG. 4 is a section view of the assembly of FIG. 2 illustrating an exemplary embodiment of an unreinforced circle support as well as a second support groove of the invention;

FIG. 5 is a section view of the assembly of FIG. 2 illustrating an exemplary embodiment of the reinforced circle support and the second support groove of the invention;

FIG. 7 illustrates a prior art circle support; and

FIG. 8 illustrates a section of the prior art circle support of FIG. 7.

DESCRIPTION OF THE ILLUSTRATED IN EMBODIMENT

Figure 1:
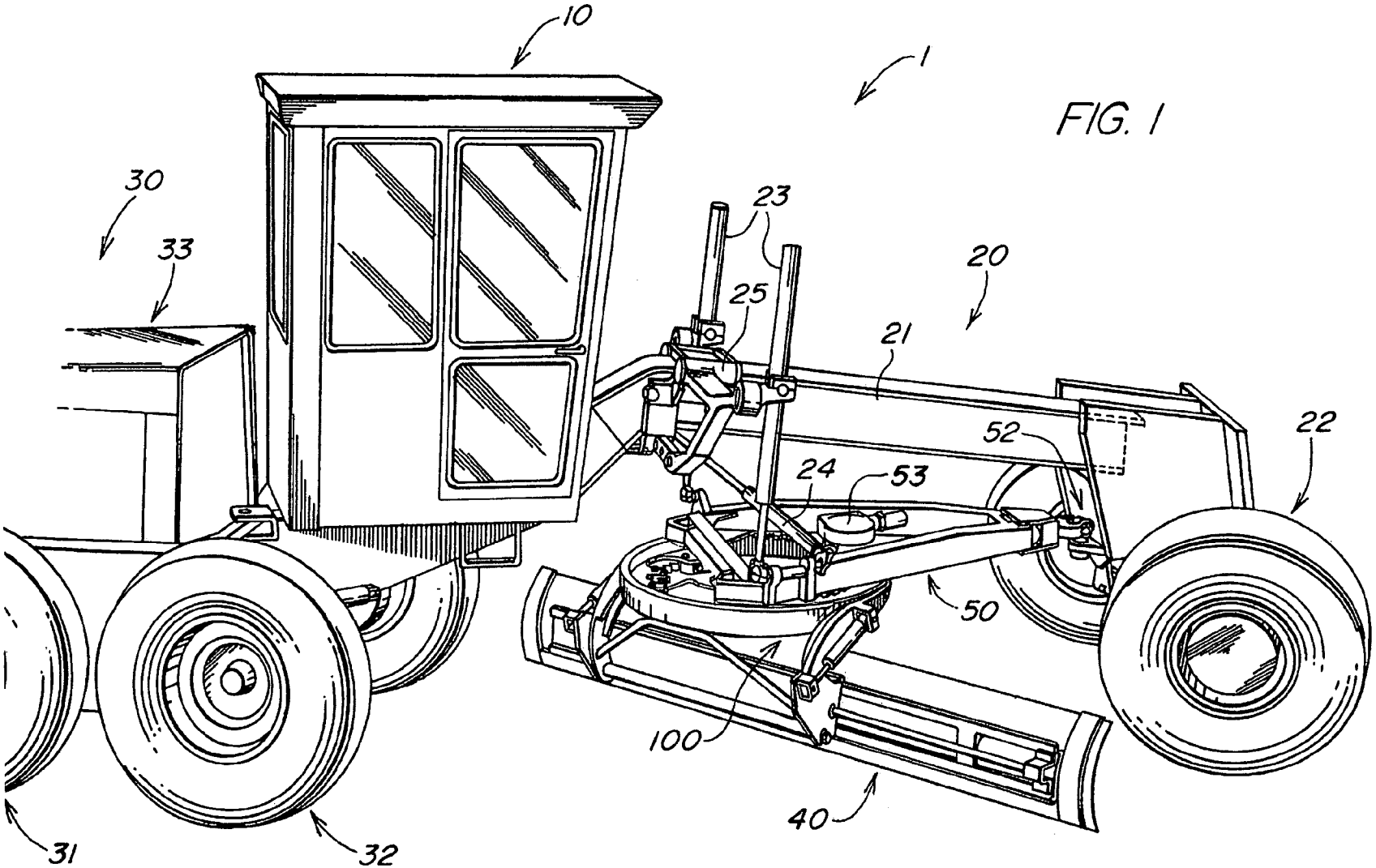
FIG. 1 is a view of the work vehicle in which the invention may be used.

FIG. 1 as an illustration of a motor grader 1 in which the invention may be used. As illustrated in FIG. 1, the motor grader 1 includes a cab 10, a front portion 20 and a rear portion 30. The front portion 20 includes: a longitudinal mainframe 21; a front wheel assembly 22; a circle group 100; a blade assembly 40: joint lift cylinders 23; a draw bar 50; and a maneuvering cylinder 24. The rear portion 30 includes: a rear frame 33; four wheels 31, 32; a propulsion system (not shown); and a hydraulic system (not shown).

The hydraulic cylinders 23 and a maneuvering cylinder 24 are pivotally attached to longitudinal mainframe 21 via bracket 25. The draw bar 50 is pivotally attached to a front end of the front portion 20 via socket 52 and suspended from a rear portion of the mainframe 21 via pivotal attachments to the hydraulic lift cylinders 23 and the maneuvering cylinder 24.

Figure 2:
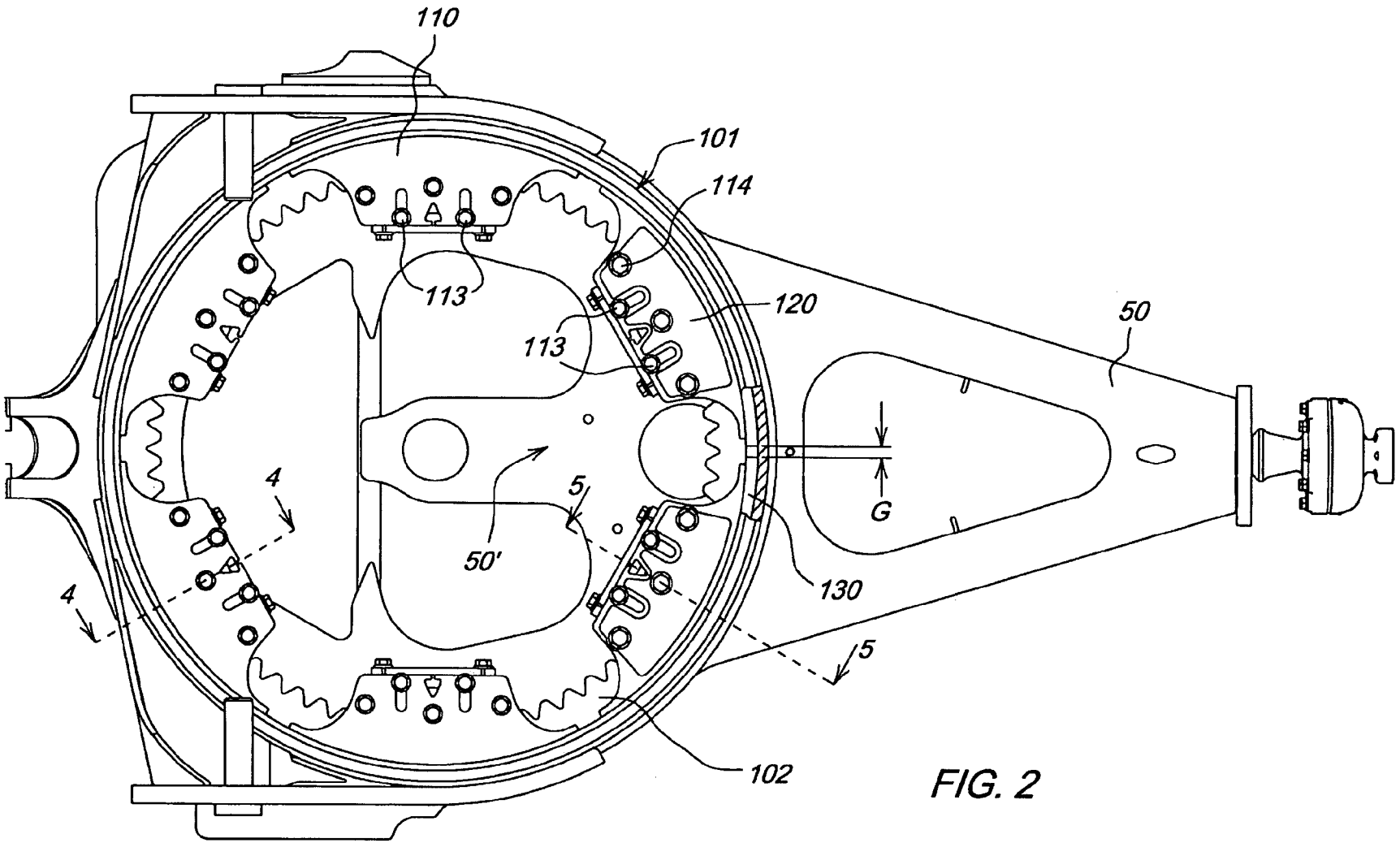
FIG. 2 is a bottom view of the draft frame and circle assembly of FIG. 1 illustrating an exemplary embodiment of the circle supports of the invention.
Figure 3:
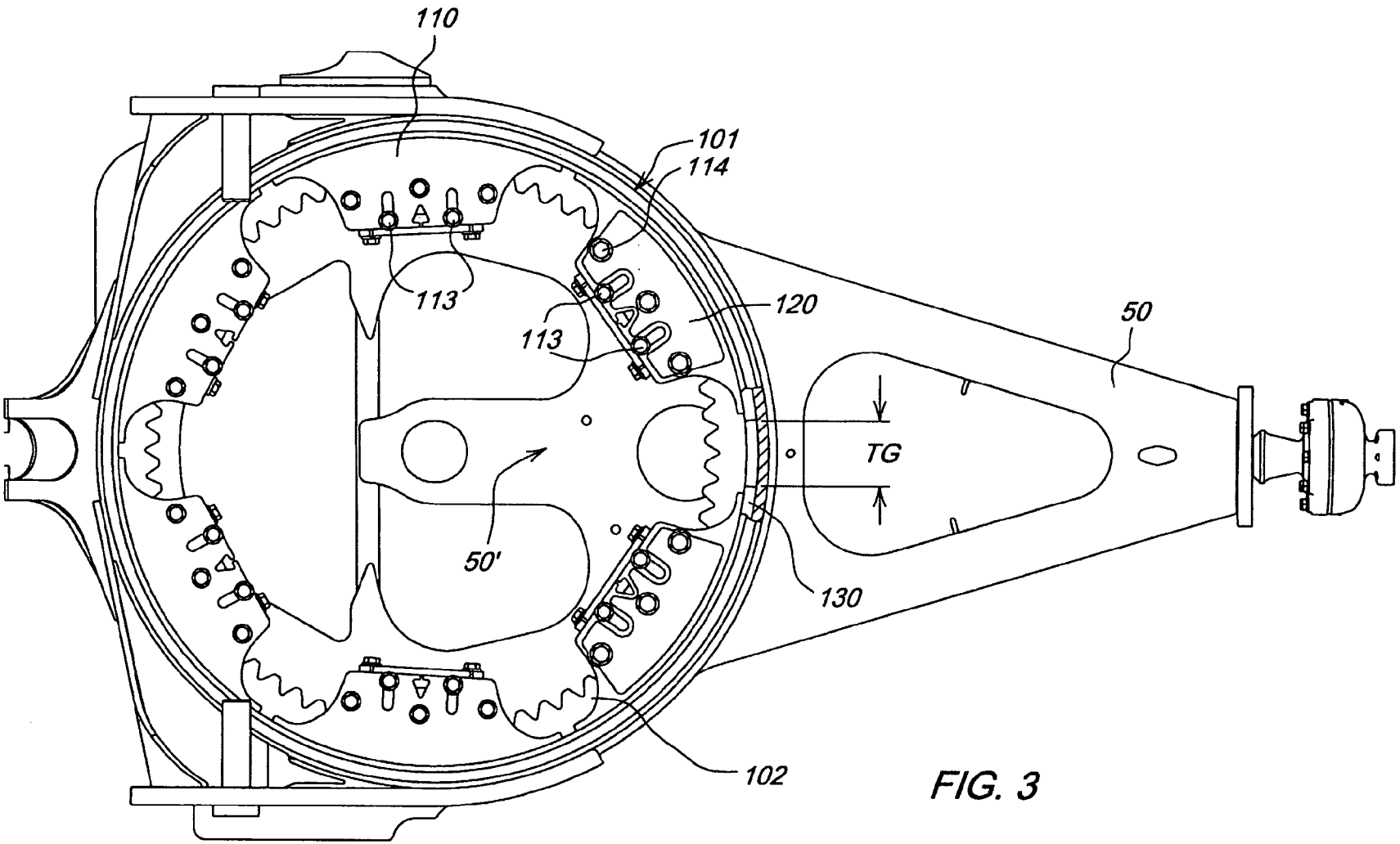
FIG. 3 is another bottom view of the draft frame and circle assembly of FIG. 1 illustrating an exemplary embodiment of the circle supports of the invention.

As illustrated in FIG. 2 the circle group 100 includes: a circle 101; support shoes 110, 120; and plastic inserts 130. The circle 101 includes a ring gear portion 102 and a cylindrical support portion 103. The cylindrical support portion 103 includes a radial support groove 104 in which a plurality of plastic inserts 130 form a second radial support groove 131. In this particular exemplary embodiment of the invention, the draw bar 50 includes at least six internally threaded spacer blocks 51 welded equidistant along a circumference of the circle attachment area 50' of the draw bar 50. Each of the support shoes 110,120 is attached to the circle attachment area 52 of the drawbar 50 via screws 113 for support shoes 110, screws 114 for reinforced support shoes 120 and one of the threaded spacer blocks 51 as illustrated in FIG. 2. A free end 110*a*, 120*a* of each of the support shoes 110, 120 rests in the second radial support groove 131 . Thus, the circle 101 is supported via the second radial support groove 131 and the free ends 110*a*, 120*a* of the support shoes 110, 120. A power device 53 moves the circle 101 in a circular direction when actuated.

In this particular exemplary embodiment of the invention, the draw bar 50 includes at least six internally threaded spacer blocks 51 welded equidistant along a circumference of the circle attachment area 52 of the draw bar 50. Each of the support shoes 110,120 is attached to the circle attachment area 52 of the drawbar 50 via screws 113 for support shoes 110, screws 114 for reinforced support shoes 120 and one of the threaded spacer blocks 51 as illustrated in FIGS. 2, 3, 4 and 5. A free end 110*a*, 120*a* of each of the support shoes 110, 120 rests in the second radial support groove 131. Thus, the circle 101 is supported via the second radial support groove 131, the plurality of inserts 130, and the free ends 110*a*, 120*a* of the support shoes 110, 120.

Figure 6:
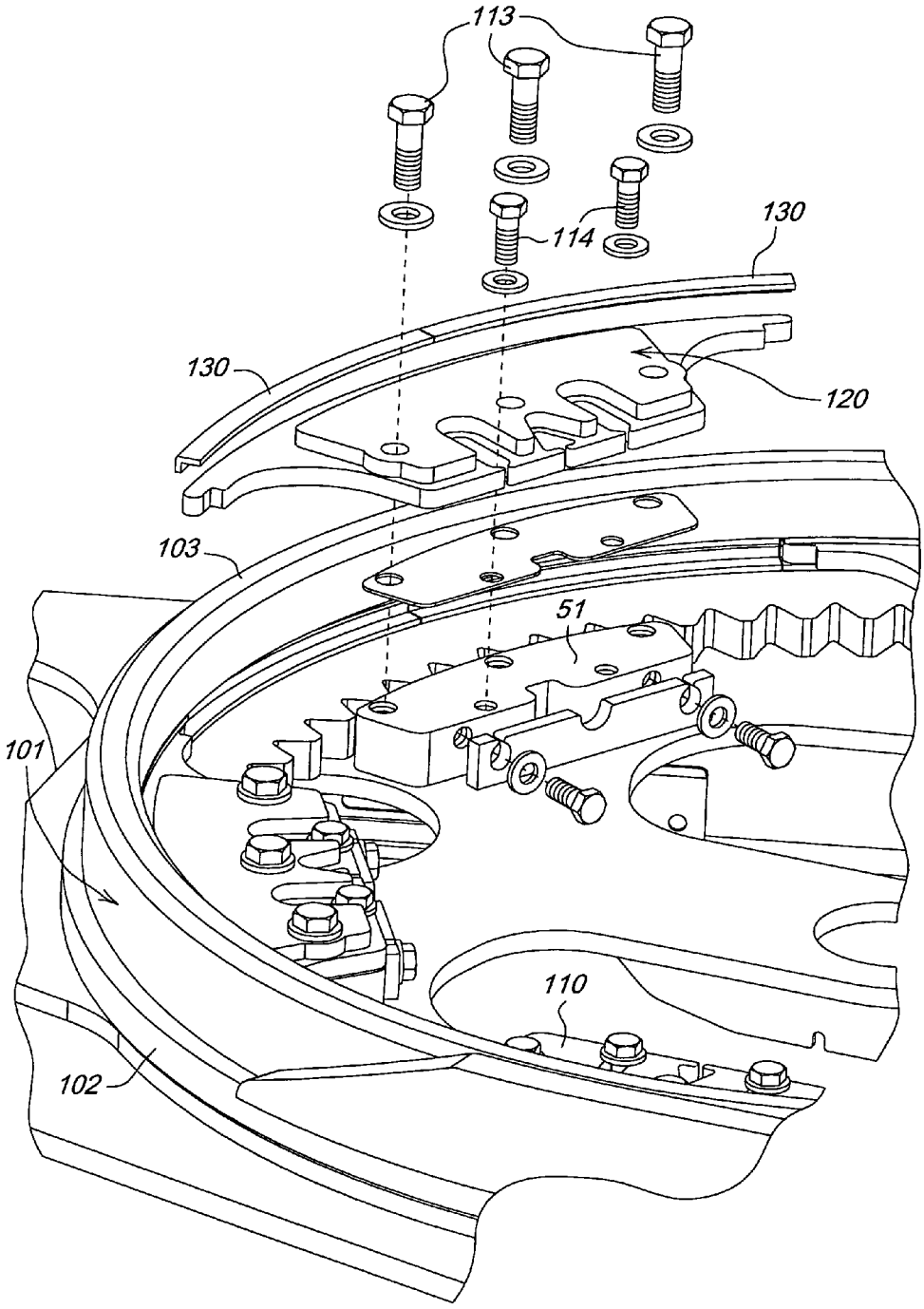
FIG. 6 is an exploded view illustrating a reinforced circle support of the invention.

FIGS. 6 and 7 illustrate the differences between prior art support shoes 60 and the support shoes 110 of the invention as illustrated in FIG. 2. As illustrated, the major differences between prior art support shoes 60 and support shoes 110 of the invention is the circle contact area afforded by the contrasting free end widths. As illustrated in FIGS. 6 and 7 to prior inserts 71, 72 are affixed to the free end of each of the prior art support shoes 70; no other inserts are evidenced in the prior art. Further, FIG. 6 shows that the contact area between the support shoes 70 and the circle 60 is relatively small. Small contact areas in this environment result in material distortions or deflections in the areas of contact, excessive wear and lower operating efficiency. Excessive wear resultant frequent adjustments and higher maintenance costs. This is to be contrasted with the advantages of the 360 degree contact afforded by the invention as well as the consequent improvements with respect to material deflections, wear and operating efficiency.

FIGS. 7 and 8 illustrate prior art support shoes 60 which may be contrasted with the support shoes 110, 120 of the invention as illustrated in FIG. 2. As illustrated, the major differences between prior art support shoes 60 and support shoes 110 of the invention is the circle contact area afforded by the contrasting free end widths. As illustrated in FIGS. 7 and 8, prior art inserts 71, 72 are affixed to the free end of each of the prior art support shoes 77; no other inserts are evidenced in the prior art. Further, FIG. 7 shows that the contact area between the support shoes 70 and the circle 60 is relatively small. Small contact areas in this environment result in material distortions or deflections in the areas of contact, excessive wear, and lower operating efficiency. Excessive wear results in frequent adjustments and higher maintenance costs. This is to be contrasted with the advantages of the virtual 360 degree contact afforded by the invention as well as the consequent improvements with respect to material deflections, wear and operating efficiency.

Having described the illustrated embodiment, it will become apparent that various modifications can be made without departing from the scope of the invention as defined in the accompanying claims.

The invention claimed is:

1. A blade assembly for a motor grader comprising:

a draw bar assembly;

a blade;

a circle for mounting the blade, the circle having a circle gear portion and a circle support portion, the circle support portion having an inner cylindrical surface, the inner cylindrical surface including a first support groove;

a plurality of inserts; and a plurality of support shoes, each of the plurality of support shoes rigidly mounted to the drawbar assembly, the each of the plurality of support shoes having a free end, the each of the plurality of inserts arranged in the support groove to expose an inner insert surface, the inner insert surface forming a second support groove, the free end being arranged to fit within the second support groove, the inserts arranged such that the sum of all gaps between the inserts is a predetermined minimal value, the free end being arranged to fit within the second support groove.

2. The blade assembly of claim 1, wherein the plurality of support shoes comprises six support shoes.

3. The blade assembly of claim 1, wherein the predetermined minimal value is less than 25 mm.

4. The blade assembly of claim 1, wherein the predetermined minimal value is less than 10 mm.

5. The blade assembly of claim 1, wherein the each of the plurality of inserts is formed from a plastic material.

6. The blade assembly of claim 1, wherein the support shoes support all loads experienced by the blade.

7. The blade assembly of claim 1, wherein at least one of the plurality of support shoes is reinforced to support greater loads experienced by the blade.

8. The blade assembly of claim 1, wherein the plurality of support shoes is arranged such that a camp between any two free ends is less than the predetermined minimal value.

* * * * *